US005353567A

United States Patent [19]

Knight et al.

[11] Patent Number: 5,353,567

[45] Date of Patent: Oct. 11, 1994

[54] INSULATION MODULE ASSEMBLY AND APPARATUS FOR INSTALLATION

[75] Inventors: Curtis L. Knight, Edmond; Robert W. Caffey, Cleveland, both of Okla.

[73] Assignee: Premier Refractories and Chemicals, Inc., Pa.

[21] Appl. No.: 47,034

[22] Filed: Apr. 12, 1993

Related U.S. Application Data

[63] Continuation of Ser. No. 510,718, Apr. 18, 1990, abandoned.

[51] Int. Cl.[5] ..... E04B 1/62; E04B 1/80; F23M 5/00

[52] U.S. Cl. ..... 52/506.03; 52/509; 110/336

[58] Field of Search ..... 52/506, 509, 510, 512, 52/410, 506.02, 506.03, 506.05; 110/336; 219/98

[56] References Cited

U.S. PATENT DOCUMENTS

| | | | |
|---|---|---|---|
| 3,031,044 | 4/1962 | Stitt et al. . | |
| 3,489,054 | 1/1970 | Feldman . | |
| 3,702,024 | 11/1972 | Baker, Jr. . | |
| 3,706,870 | 12/1972 | Sauder et al. . | |
| 3,738,217 | 6/1973 | Walker . | |
| 3,819,468 | 6/1974 | Sauder et al. . | |
| 3,881,288 | 5/1975 | Fay . | |
| 3,892,396 | 7/1975 | Monaghan . | |
| 3,960,460 | 6/1976 | Fischer . | |
| 3,993,237 | 11/1976 | Sauder et al. . | |
| 4,018,023 | 4/1977 | Anderson . | |
| 4,030,261 | 6/1977 | Coleman . | |
| 4,032,742 | 6/1977 | Kendrick et al. . | |
| 4,117,297 | 9/1978 | Sholle | 219/98 |
| 4,120,641 | 10/1978 | Myles . | |
| 4,139,975 | 2/1979 | Baker . | |
| 4,177,616 | 12/1979 | Lampert . | |
| 4,244,269 | 1/1981 | Gorell . | |
| 4,248,023 | 2/1981 | Dunlap . | |
| 4,291,514 | 9/1981 | Harvey . | |
| 4,306,137 | 12/1981 | Shoup et al. | 219/98 X |
| 4,370,840 | 2/1983 | Bisbee et al. . | |
| 4,424,434 | 1/1984 | Pease et al. | 219/98 X |
| 4,478,022 | 10/1984 | Wilkinson et al. . | |
| 4,494,295 | 1/1985 | Herring . | |
| 4,562,328 | 12/1985 | Shoup | 219/98 |
| 4,571,911 | 2/1986 | Dunlap et al. . | |
| 4,574,995 | 3/1986 | Sauder et al. . | |
| 4,594,495 | 6/1986 | Glorioso | 219/98 |
| 4,597,702 | 7/1986 | Brown . | |
| 4,699,242 | 6/1987 | Johnson et al. . | |
| 4,803,822 | 2/1989 | Deren | 52/506 |
| 4,850,171 | 7/1989 | Deren | 52/506 |
| 4,885,890 | 12/1989 | Deren | 52/506 |
| 4,984,405 | 1/1991 | Sauder | 52/506 |
| 5,010,706 | 4/1991 | Sauder | 52/509 X |

OTHER PUBLICATIONS

Product Specifications, Ceramic Fiber Modules, The Carborundum Co., Niagara Falls, N.Y.

*Primary Examiner*—Carl D. Friedman
*Assistant Examiner*—Kien Nguyen
*Attorney, Agent, or Firm*—Ostrolenk, Faber, Gerb & Soffen

[57] ABSTRACT

An insulation module assembly for attachment to wall requiring insulation includes an anchor member having a base portion and an arm portion that extends at an angle from an end of the base portion and away from the wall. The base portion and the arm portion have openings formed therein. A hollow elongated anchor tube has opposing ends extending through the openings of the arm portions. The anchor tube includes beveled open ends formed therein. A layer of insulating material is impaled on the anchor tube and positioned on opposite sides of the anchor member. Access is provided to the wall through the layers of insulating material and the opening of the base portion of the bracket. A method for installing the insulation module assembly includes inserting a current carrying rod including a stud assembly attached to an end thereof through the assembly until the stud assembly operatively engages the anchor member and protrudes through the insulating layers. The current carrying rod is operatively engaged with a stud welding apparatus and current from the stud welding apparatus is then applied through the current carrying rod to the stud assembly to stud weld the insulation module assembly to the wall.

36 Claims, 5 Drawing Sheets

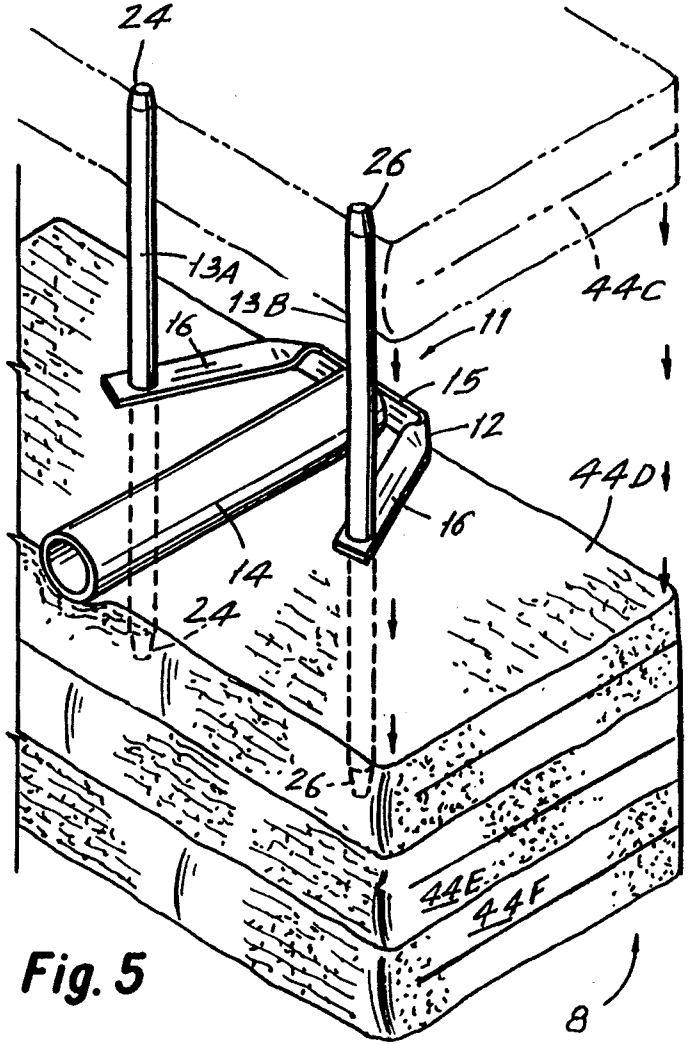
Fig. 5
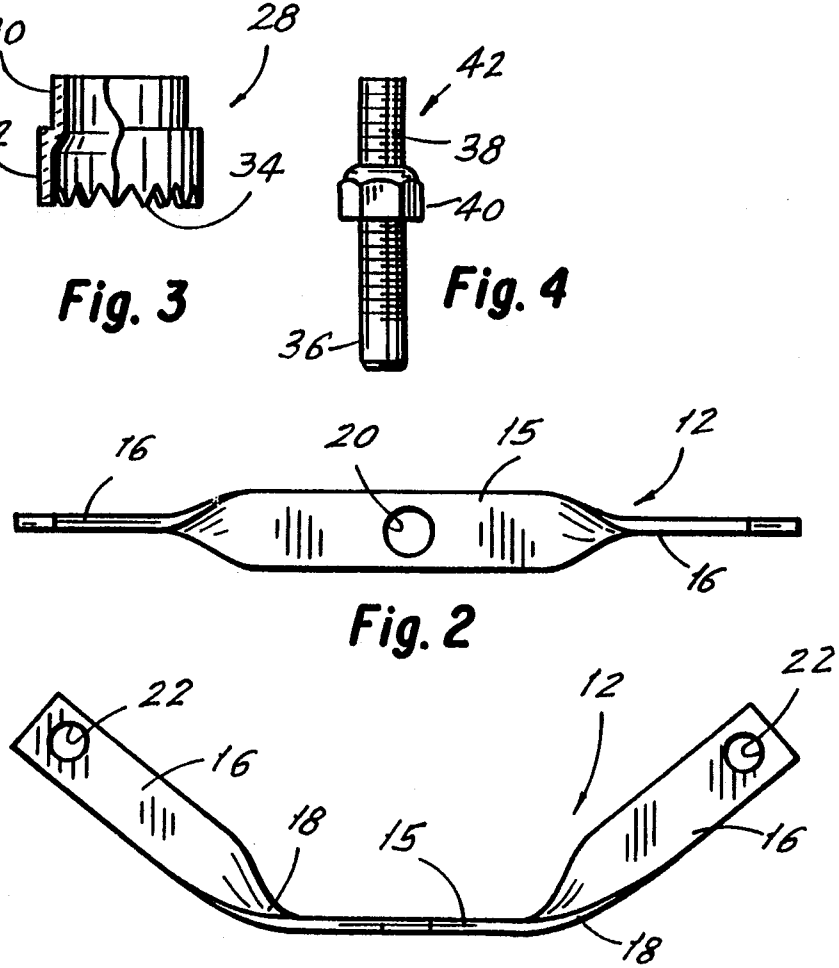
Fig. 1
Fig. 2
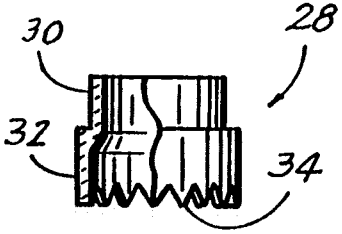
Fig. 3
Fig. 4

80
76
78
57
14
8
40
38
12
28
36
10
74
82

INSULATION MODULE ASSEMBLY AND APPARATUS FOR INSTALLATION

This is a continuation of application Ser. No. 07/510,178 filed on Apr. 18, 1990 now abandoned.

BACKGROUND OF THE INVENTION

The present invention relates to insulation modules, and more particularly to insulation modules which are easy to manufacture and install.

In many industrial applications it is necessary to insulate the interior walls of a high temperature chamber or furnace, such as the wall of a fire heater in a refinery or petrochemical plant. The walls of such structures are usually formed of metal and the preferred insulation is formed of blankets of refractory fibrous material such as ceramic fiber folded into modules.

The modules are attached to the wall in a variety of ways. The modules usually have some type of attachment brackets imbedded internally which are used to secure the module to the shell using bolts, self tapping screws, studs embedded in bulky solid material or studs that are first welded to the shell in patterns to match the insulation modules. The latter requires that each module be subsequently mounted onto each stud. All of these methods have disadvantages such as penetration of the shell, bulkiness or excessive time required to lay out the fastener pattern, drilling the bolt hole, or welding the studs in place using conventional welding processes which do not allow for verifying the integrity of the weld. Additional time is then required to locate the module on the bolt or stud and install a nut between the blanket folds or layers in the insulation, with the installer working in an area where he cannot see the work being done. This is a slow and tedious process.

U.S. Pat. Nos. 3,706,870, 3,819,468 and 3,993,237 all relate to high temperature insulation modules and methods and apparatus for installation. However, these references relate to fibrous insulation modules incorporating bulky, rigid blocks of refractory material having embedded therein self contained internal fasteners as a means for stud welding the module to a furnace wall. The fasteners are not readily located through the layers of insulation.

Accordingly, it is an object of the present invention to provide an insulation module assembly that can be stud-welded directly through the assembly to a wall that requires insulation using standard readily available electric arc stud welding equipment and components.

A further object is to provide such an assembly which allows for the integrity of the weld to be verified.

A still further object is to provide such an assembly that is simple to install and that can be installed quickly and efficiently.

SUMMARY OF THE INVENTION

It has now been found that the above and other objects of the present invention are attained in an insulation module assembly for attachment directly through the assembly to a wall requiring insulation. The assembly includes a plurality of insulating layers stacked in parallel alignment. The insulating layers form a first face to be in operative engagement with the wall and a parallel second face opposite to the first face. A fastener is interposed between the insulating layers to fasten the layers to the wall.

The insulating layers are retained in close parallel alignment when fastened to the wall by a hollow elongated anchor tube having beveled open ends formed therein. The anchor tube is operatively engaged with the fastening means and includes the insulating layers impaled thereon. Access is provided thereon to the wall and the fastening means through the first and second faces of the insulating layers.

In a preferred embodiment, the fastener includes an anchor member having a base portion and first and second arm portions that extend at an angle from opposite ends of the base portion. The base portion includes a first opening formed therein and the first and second arm portions have respective second and third openings formed therein.

Preferably, the base portion of the anchor member is oriented in a plane parallel to and lies substantially flush with the first face of the insulating layers. The arm portions at the second and the third openings are oriented in a plane normal to the first face.

An electrically insulating hollow elongated member extends through the first and second faces of the insulating layers to provide access to the wall and the fastening means through the insulation module assembly. The hollow elongated member includes a first open end and an opposing second open end. The first open end is aligned with and projects from the first opening of the base portion away from the wall.

In a preferred embodiment, a stud assembly is in operative engagement with the anchor member to secure the insulation module assembly to the wall. Preferably, the stud assembly includes a threaded stud having a tip formed at one end and a threaded nut received by the threaded stud. The stud assembly is secured to the wall through the hollow elongated member and the first opening of the base portion of the anchor member.

Preferably, the stud means is electrically insulated from the fastening means by an annular electrically insulating ferrule. The ferrule includes a fitted portion adapted to be received in the opening of the base portion between the wall and the anchor member. The fitted portion of the ferrule is sized to allow a portion of the threaded stud to pass therethrough to engage the wall.

In a preferred embodiment, an elongated electrically conductive stud adapter operatively engages the stud assembly with welding apparatus through the hollow elongated member. The welding apparatus includes components to stud weld and properly align the stud assembly with the wall in substantially perpendicular alignment.

Preferably, the stud welding apparatus includes a hollow tube adapter having a shoulder portion and a fitted portion to support the stud welding apparatus when welding the insulation module assembly to the wall. The fitted portion is received by the hollow elongated member until the shoulder portion abuts the second open end of the hollow elongated member.

A foot piece is secured to and supported by the tube adapter. The foot piece and the tube adapter allow the stud adapter to pass therethrough. The foot piece slidingly engages the stud gun along an axis normal to the plane of the wall.

In a preferred embodiment, the stud adapter operatively engages the stud gun with the stud assembly through the hollow elongated member, the tube adapter and the foot piece. Preferably, the distance between the tip of the threaded stud and the shoulder portion of the tube adapter is substantially equal to the thickness of the insulating layers.

In a preferred embodiment, a method for stud welding an insulation module assembly through the assembly to a wall requiring insulation includes positioning the insulation module assembly against the wall. A current carrying rod including the stud assembly attached to an end thereof is inserted through the hollow elongated member until the stud assembly is in operative engagement with the anchor member and protrudes through the insulating means to be proximate to the wall. The current carrying rod is operatively engaged with the stud welding apparatus and current is applied from the stud welding apparatus through the current carrying rod to the stud assembly to stud weld the stud assembly to the wall.

In a preferred embodiment, a support means is fitted over the current carrying rod to support and align the stud welding apparatus and to transfer pressure from the stud welding apparatus through the hollow elongated member to the anchor member to properly align the stud assembly with the wall.

In a preferred embodiment, the stud welding apparatus engages the support means until the stud welding apparatus enters into electrically conductive contact with the current carrying rod. Downward pressure is then exerted on the stud welding apparatus to align and contact the stud assembly with the wall.

Preferably, a wrench enters into operative engagement with the threaded nut after the stud assembly has been stud welded to the wall. The threaded nut of the threaded stud is tightened to firmly secure the anchor member to the wall and to verify the integrity of the weld.

BRIEF DESCRIPTION OF THE DRAWINGS

For the purpose of illustrating the invention, there is shown in the drawings an embodiment which is presently preferred; it being understood, however, that the invention is not limited to the precise arrangements and instrumentalities shown.

FIG. 1 is a side elevational view of an anchor of the present invention;

FIG. 2 is a top plan view of the anchor of FIG. 1;

FIG. 3 is a side elevational view, partially in cross-section, of an electrically insulating ferrule of the present invention;

FIG. 4 is a side elevational view of a stud assembly of the present invention;

FIG. 5 is an exploded isometric view of the insulation module assembly of the present invention;

DETAILED DESCRIPTION OF THE PREFERRED EMBODIMENT

Figure 6:
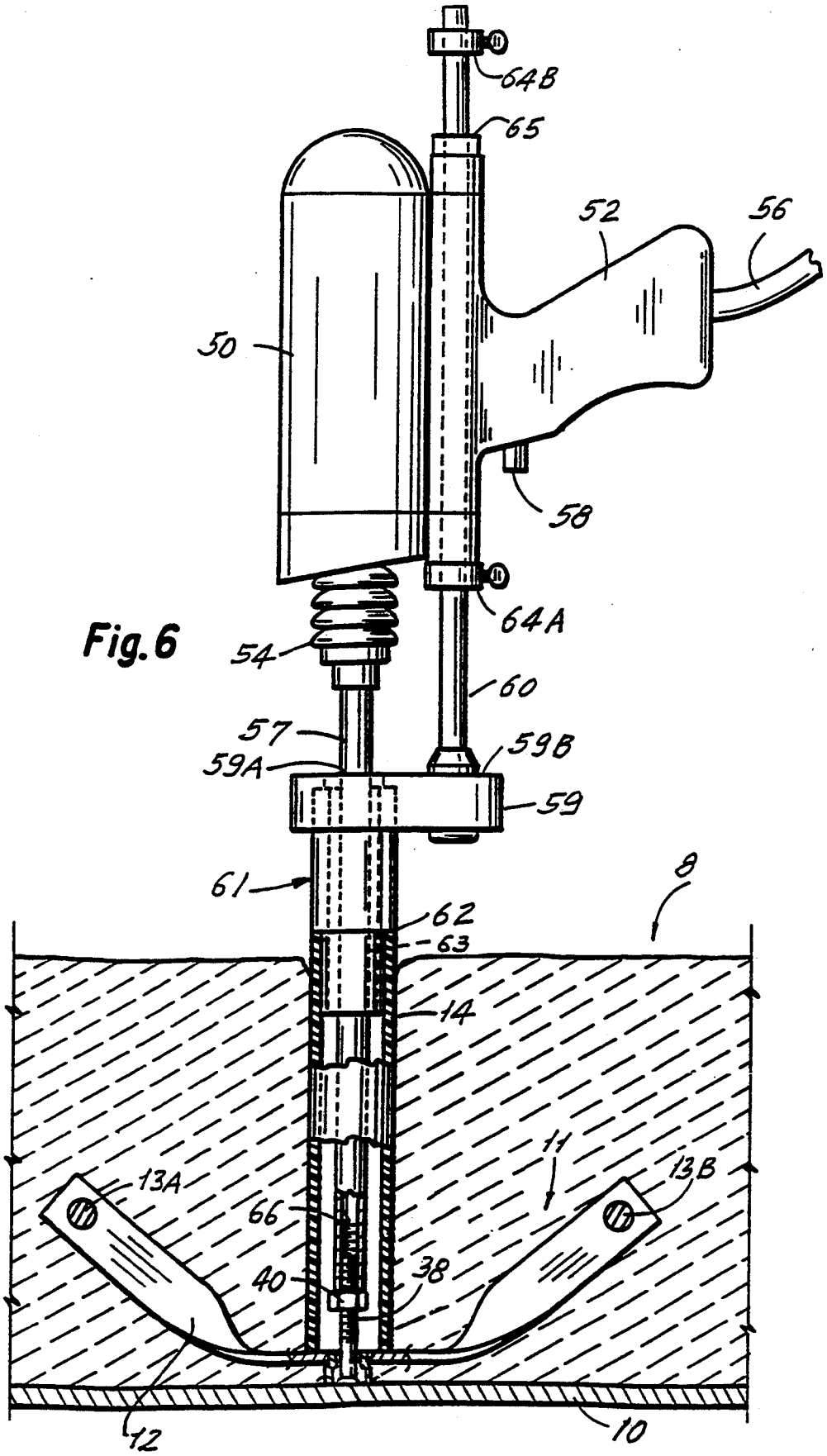
FIG. 6 is a cross-sectional side elevational view of the insulation module assembly of the present invention being welded to a metal wall using arc stud welding equipment.
Figure 7:
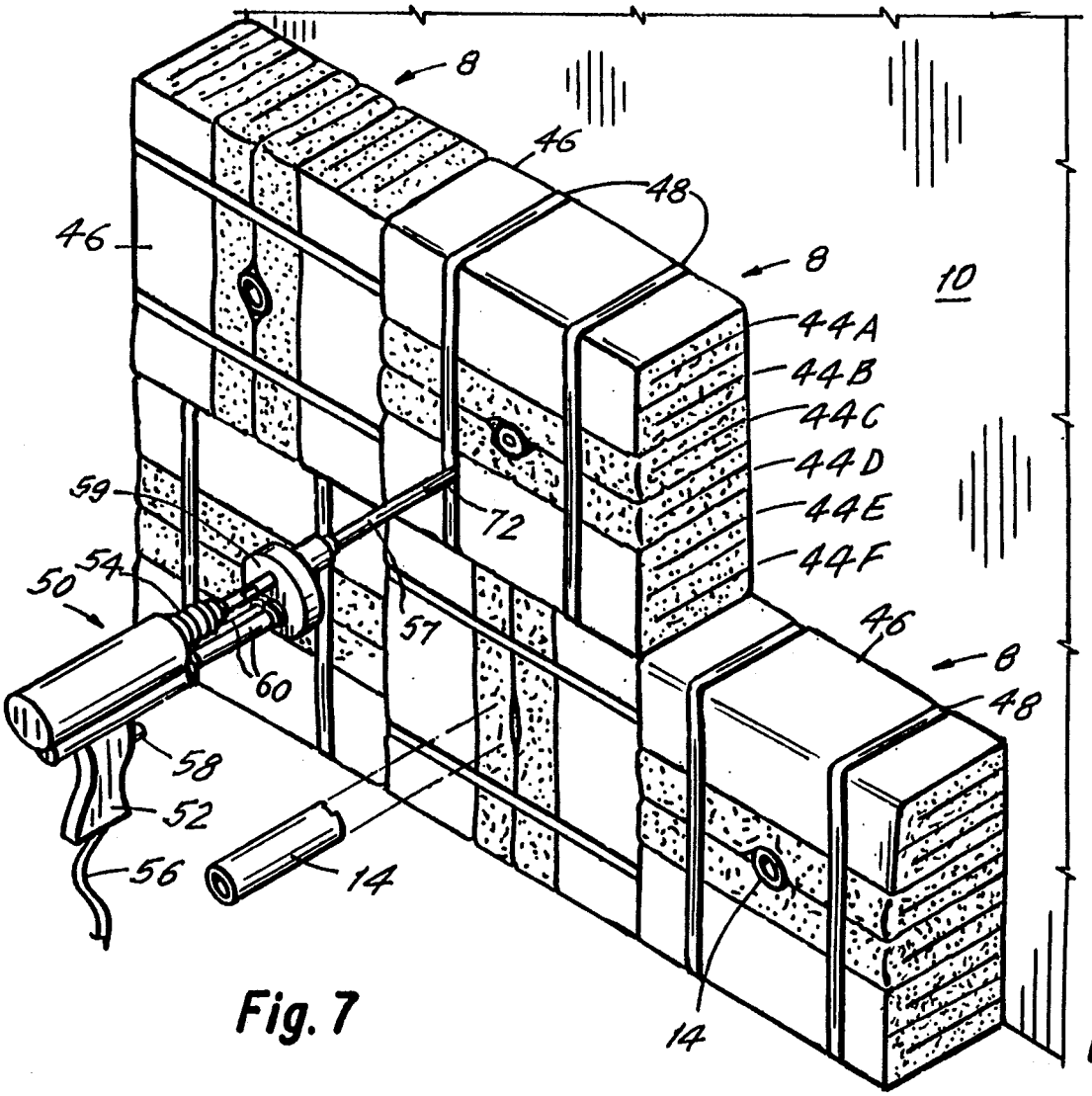
FIG. 7 is an isometric view showing the process of installing a plurality of insulation module assemblies of the present invention.

Referring now to the drawings wherein like numerals indicate like elements, there is shown in FIGS. 5–7 a ceramic fiber module assembly designated generally as 8. The ceramic fiber module assembly 8 is used for insulation of a metal wall 10, as shown in FIGS. 6 and 7.

The ceramic fiber module assembly 8 includes an anchor assembly 11, shown in FIG. 5, for securing the ceramic fiber module assembly 8 to the wall 10. The anchor assembly 11 includes a bracket or anchor member 12, a pair of anchor tubes or bar members 13A, 13B, and an electrically insulating hollow elongated member or tube 14, shown in FIGS. 5 and 6, projecting from the anchor 12. The insulating tube 14 is formed from any type of material that is nonconductive, such as PVC. The anchor 12 is formed of corrosion resistant steel (e.g. stainless steel) or any metal alloy or other material possessing suitable corrosion and heat resistant properties.

The anchor 12, FIGS. 1–7, includes an intermediate base portion 15 and opposed arm portions 16. The base portion 15 is formed to be parallel to, and to be flat against, the wall 10. A central mounting opening 20 is formed in the base portion 15 at its midpoint.

The arm portions 16 of the anchor 12 veer off at bends 18 relative to the intermediate portion 15 and both extend at the same acute angle away from the wall 10. The bends 18 are also twisted 90° so that the outer portion of the arm portions 16 are in a common plane normal to the plane of base portion 15, as best seen in FIGS. 1 and 2.

Formed in each of the arm portions 16 is an opening 22. Each opening 22 is configured to receive one of the anchor tubes 13A,B. The anchor tubes 13A,B are formed of corrosion resistant steel (e.g. stainless steel) tubing stock or any metal alloy or other material possessing suitable corrosion and heat resistant properties. Each anchor tube 13A,B is hollow and includes open ends 24, 26 beveled to a burr free sharp edge. The openings 22 are preferably oriented and so placed on the arm portions 16 that the anchor tubes 13A,B are in parallel planes as to each other and as to the plane of base portion 15.

Referring now to FIGS. 2, 3, an annular electrically insulating ferrule 28 formed of a ceramic material or any other electrically insulating material capable of withstanding high temperatures, includes a fitted smaller diameter portion 30 and a larger diameter portion 32. The larger diameter portion 32 includes a serrated edge 34. The outside diameter of the fitted portion 30 is sized to fit snugly into the opening 20 of the anchor 12 and the inside diameter of the ferrule 28 must be sized to allow the tip 36, FIG. 4, of a threaded stud 38 to pass therethrough. A nut 40 of a desired size is received on the threaded stud 38. The threaded stud 38 and the nut 40 form a stud assembly 42. The threaded stud 38, the nut 40 and the ferrule 28 can be of a type that is purchased off-the-shelf from any of the well known suppliers.

Referring now to FIGS. 5, 7, the ceramic fiber module assembly 8 further includes a plurality of insulating layers 44A through 44F, typically made of ceramic fiber, positioned on opposite sides of the anchor 12. In the preferred embodiment, layers 44A,B,C on one side of the anchor 12, and layers 44D,E,F on the opposite side of the anchor 12 are respectively formed as submodules, each submodule forming one-half of the ceramic fiber module assembly 8.

The two submodules 44A,B,C and 44D,E,F are each formed by folding a ceramic fiber insulation blanket of a given dimension to a desired size in a serpentine fashion which forms a ceramic fiber module made of multiple folds of the ceramic fiber blanket. The one piece folded blanket is then cut in half longitudinally by any of the known methods to yield submodules 44A,B,C and 44D,E,F. Each layer of the submodules consists of a double fold of the ceramic fiber blanket for a total of twelve layers of insulating material. In larger modules, the folded blanket may be cut laterally, between folds, to yield submodules wherein the folds remain in serpentine configuration.

It will be appreciated by those skilled in the art that the ceramic fiber module assembly 8 can be made from as few as two insulating layers to as many insulating layers as may be required. For example, the ceramic fiber module assembly 8 can be made of eight double folds of ceramic fiber insulation blanket for a total of sixteen layers of insulating material, each submodule including four double folds or eight layers of insulating material.

The ceramic fiber module assembly 8 is assembled by first securing the anchor assembly 11 to a supporting surface such as a table, not shown. The anchor tubes 13A,B are inserted through the openings 22 of the anchor 12 and the insulating tube 14 is joined with the anchor 12 so that the insulating tube 14 projects from the opening 20 of the anchor 12.

The insulating tube 14 is aligned with the opening 20 of the anchor 12 to provide a pathway between the outer face of the ceramic fiber module assembly 8 and the wall 10. The pathway allows for entrance of and then for welding the threaded stud 38 to the wall 10 directly through the ceramic fiber module assembly 8. The insulating tube 14 should have an internal diameter greater than the diameter of the nut 40 and should protrude above the face of the ceramic fiber module assembly 8 opposite the wall 10.

It will be appreciated by those skilled in the art that because the stud assembly 42 is not imbedded in the ceramic fiber module, the pathway provided by the insulating tube 14 and the opening 20 of the anchor 12 allows the ceramic fiber module assembly 8 to be installed by methods other than stud welding. For example, a self-tapping screw inserted into the insulating tube to be in operative engagement with the anchor 12 will secure the ceramic fiber module assembly 8 to the wall 10. The ceramic fiber module assembly 8 can even be secured to the wall 10 by a veneering process.

The submodules 44A,B,C and 44D,E,F are impaled on anchor tubes 13A,B on opposite sides of the anchor 12. The sharp, beveled ends 24, 26 of the anchor tubes 13A,B allow for its easy penetration through the insulating layers 44A–F. The anchor tubes 13A,B should be supported in parallel orientation during the impaling process. The anchor tubes 13A,B support and hold together each of the layers 44 A–F, particularly after they experience shrinkage under high temperatures. The anchor tubes 13A,B also add rigidity to the ceramic fiber module assembly 8.

Once the submodules 44A,B,C and 44D,E,F are impaled on anchor tubes 13A,B, the subassembly of the submodules 44A,B,C and 44D,E,F and the anchor assembly 11 is compressed to a preset dimension, typically undergoing a twenty-five (25) to thirty-three (33) percent compression to preferably result in a 12″×12″ sized ceramic fiber module assembly 8, although the ceramic fiber module assembly 8 can be made in other sizes, e.g. 6″×12″, 12″×24″ etc. The tube 14 is held in place between the submodules by compression.

After the ceramic fiber module assembly 8 has been compressed to the preset dimension, panels of rigid material 46, such as cardboard, are placed over opposite ends of the ceramic fiber module assembly 8 covering the top and side faces of the ceramic fiber module assembly 8, as shown in FIG. 7. Straps 48 are then wrapped around the ceramic fiber module assembly 8 to hold the module together. The panels of cardboard 46 and the straps 48 are used to hold the ceramic fiber module assembly 8 at its present dimension under compression and to avoid pinching of the ceramic fiber. In the finished assembly, the anchor assembly 11 is located at the center of the ceramic fiber module assembly 8 and the base portion 15 of the anchor 12 is exposed flush to the surface of the ceramic fiber module assembly 8 facing the wall 10.

The ceramic fiber module assembly 8 is now complete and may be shipped to an installation site. When at the installation site the ceramic fiber module assembly 8, with its anchor assembly 11, is ready to be stud welded directly to the metal wall 10 "out of the box" without any disassembly, deforming or damage to the ceramic fiber module assembly 8.

At the installation site, the ceramic fiber module assembly 8 is stud welded to the wall 10 by utilizing common readily available electric arc stud welding equipment known to those skilled in the art. This equipment is manufactured by several companies such as TRW Nelson Stud Welding Div., of Elyria, Ohio or Erico Fastening Systems, Inc., of Morristown, N.J.

Referring now to FIG. 6, the arc stud welding equipment generally includes a stud gun 50 having a handle portion 52, and a gun chuck 54. A current carrying rod 57, not supplied by the manufacturer, is connected within the stud gun 50 to a current carrying cable 56 by the gun chuck 54. The gun chuck 54 includes an internal solenoid means and a spring means, not shown, in operative engagement with the current carrying rod 57. A switch 58 regulates the flow of current through the current carrying rod 57.

Figure 15:
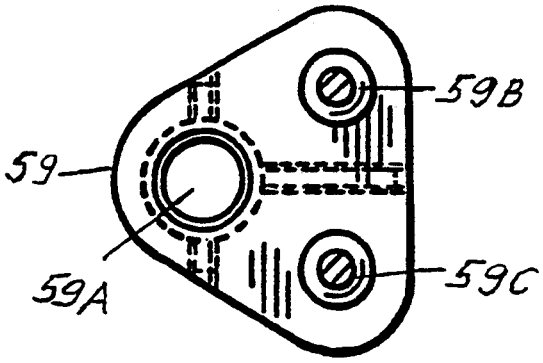
FIG. 15 is the tube adapter, foot piece and guides of FIG. 14 taken along line 15—15 of FIG. 14; and, FIG. 16 is a side elevation view of the tube adapter of the present invention.
Figure 14:
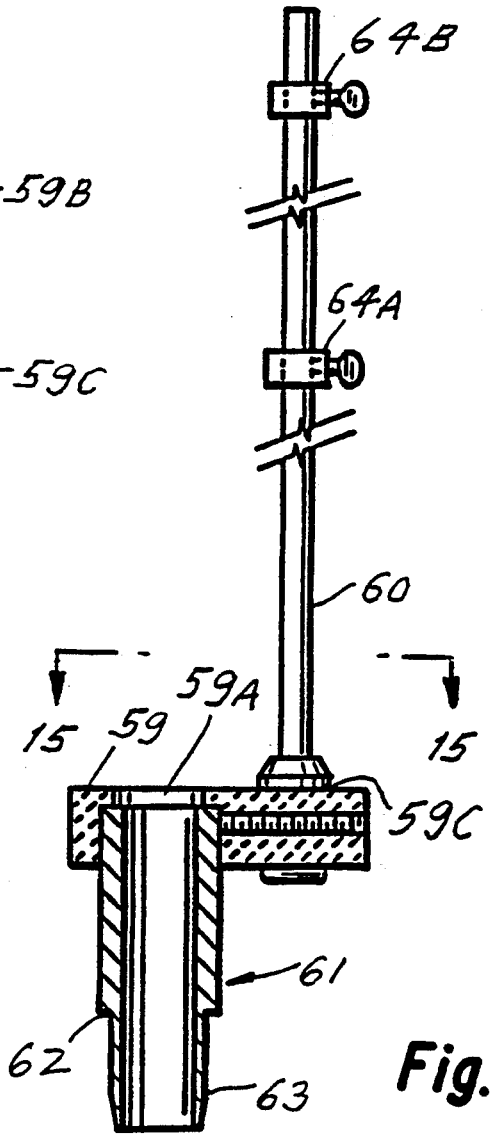
FIG. 14 is a cross-sectional side elevation view of a tube adapter, foot piece and guide legs of the present invention.

The stud welding equipment further includes a foot piece 59 having three openings 59A,B,C formed therein as shown in FIG. 15 and a pair of guide legs 60 of desired length projecting from the openings 59B, 59C normal to the face of the foot piece 59 to support the stud gun 50, as shown in FIGS. 7, 14. The foot piece 59 and the guide legs 60 are assembled as set forth in the instructions of the manufacturer of the stud welding equipment.

Figure 16:
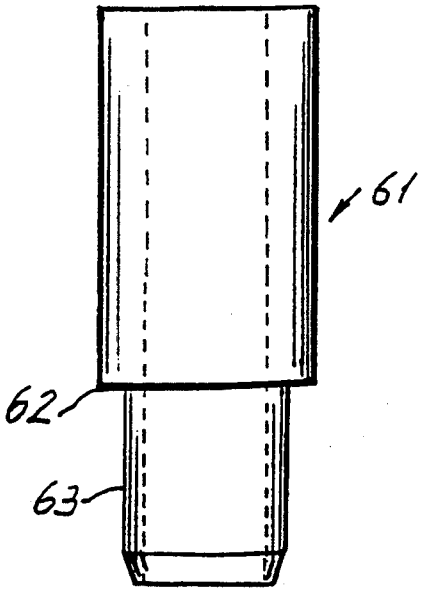

Referring now to FIGS. 6, 14, 16, the arc stud welding equipment is used in connection with a hollow tube adapter 61, also not supplied by the manufacturer of the stud welding equipment. The tube adapter 61 includes a shoulder portion 62 and a fitting 63 integrally formed therewith adapted to be received in the end of the insulating tube 14, as shown in FIG. 6. The tube adapter 61 is aligned with the opening 59A of the foot piece 59 and firmly secured in place in the foot piece 59 by existing set screws, not shown.

When inserted in the insulating tube 14, the tube adapter 61 and the foot piece 59 function to support the stud gun 50 and to align the current carrying rod 57 and the stud 38 with the wall 10 in substantially perpendicular orientation. The tube adapter 61 and the foot piece 59 also serves to transfer pressure from the stud gun 50 through the insulating tube 14 to the anchor 12 and the ferrule 28 to assure that the anchor 12 seats the ferrule 28 against the wall 10.

Figure 11:
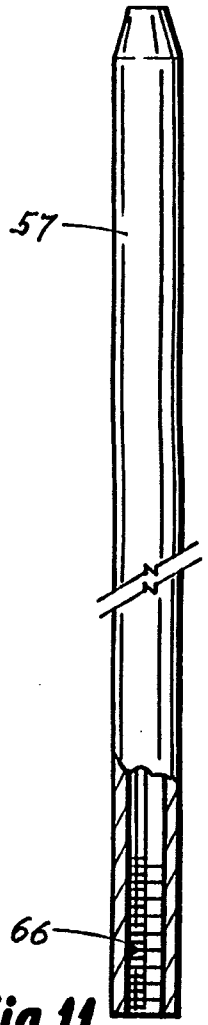
FIG. 11 is a partial cross-sectional side elevational view of a current carrying rod of the present invention including a threaded stud adapter.

Referring now to FIGS. 6, 11, a distal end of the current carrying rod 57 includes a threaded opening to form a threaded stud adapter 66 which retains the threaded stud 38. The threaded stud adapter 66 of the rod 57 is used to connect the stud assembly 42 which is on the bottom of the ceramic fiber module assembly 8, adjacent to the wall 10, to the gun chuck 54, which is on top of the ceramic fiber module assembly 8, opposite wall 10, directly through the ceramic fiber module assembly 8.

The threaded stud adapter 66 and the current carrying rod 57 are made of a material, such as metal, that will conduct the weld current. They are to be of a suitable length to extend through the ceramic fiber module assembly 8 and through the tube adapter 61 to connect the gun chuck 54 with the stud assembly 42 when the stud 38 is in contact with the wall 10.

Figure 12:
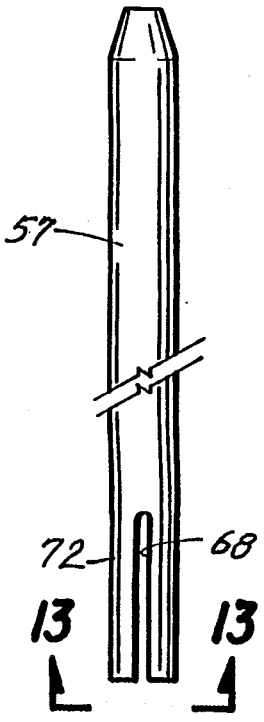
FIG. 12 is a side elevation view of the current rod of the present invention including a split collet stud adapter.
Figure 13:
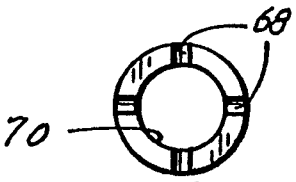
FIG. 13 is the split collet stud adapter of FIG. 12 taken along line 13—13 of FIG. 12.

FIG. 12 shows a preferred embodiment of the threaded stud adapter 66 in which instead of a threaded opening, the current carrying rod 57 has slots 68 formed therein surrounding an opening 70 located at its distal end to form a split collet stud adapter 72. The threaded stud assembly 42 is telescopically received and retained in the split collet adapter 72. The split collet stud adapter 72 allows the stud assembly 42 to be engaged and disengaged from the current carrying rod 57 more readily than with the threaded stud adapter 66.

Referring now to FIGS. 6, 7, to stud weld the ceramic fiber module assembly 8 to the wall 10, the fitted portion 30 of the ferrule 28 is first installed into the opening 20 of the anchor 12 on the side of the ceramic fiber module assembly 8 adjacent to the wall 10. Adhesive can be used to hold the ferrule 28 in the opening 20 if needed. Next, the stud assembly 42 is installed in the stud adapter 66 or 72, whichever is preferred, until the end of the stud adapter bottoms against the nut 40. The current carrying rod 57 including the stud assembly 42 is then inserted through the insulating tube 14 until the stud 38 protrudes outwards from the side of the ceramic fiber module assembly 8 adjacent the wall 10 through the ferrule 28.

The ceramic fiber module assembly 8 is placed in the desired position against the wall 10 and held in place. The fitting 63 of tube adapter 61 (secured to the foot piece 59) is placed over the current carrying rod 57 and inserted into the insulating tube 14 until the shoulder portion 62 of the tube adapter 61 abuts the end of the insulating tube 14. The current carrying rod 57 should be centered in the tube adapter 61. A stop collar 64A typically including set screws, now shown, is then loosely installed on each guide leg 60. The stop collar 64A is a standard collar of appropriate size to fit the guide legs 60.

The stud gun 50 is positioned by inserting the guide legs 60 through a pair of passages 65 formed in the stud gun 50 adapted to receive and retain the guide legs 60. The stud gun 50 should freely slide on the guide legs 60. The stud gun 50 is slid down the guide legs 60 until the gun chuck 54 receives the current carrying rod 57. Preferably, the gun chuck 54 includes spring jaws or if available set screws, not shown, to allow maximum grip on the current carrying rod 57. A second stop collar 64B typically including set screws, not shown, is positioned towards the end of one of the guide legs 60 and then tightened to prevent the stud gun 50 from sliding off of the guide legs 60.

With the stud 38 in contact with the wall 10, the stop collar 64A is adjusted to obtain ⅛" to 3/16" clearance to the stud gun 50, not shown. This sets the required plunge dimension. This adjustment should not require repeating but should be checked frequently.

Figures 8, 9, 10:
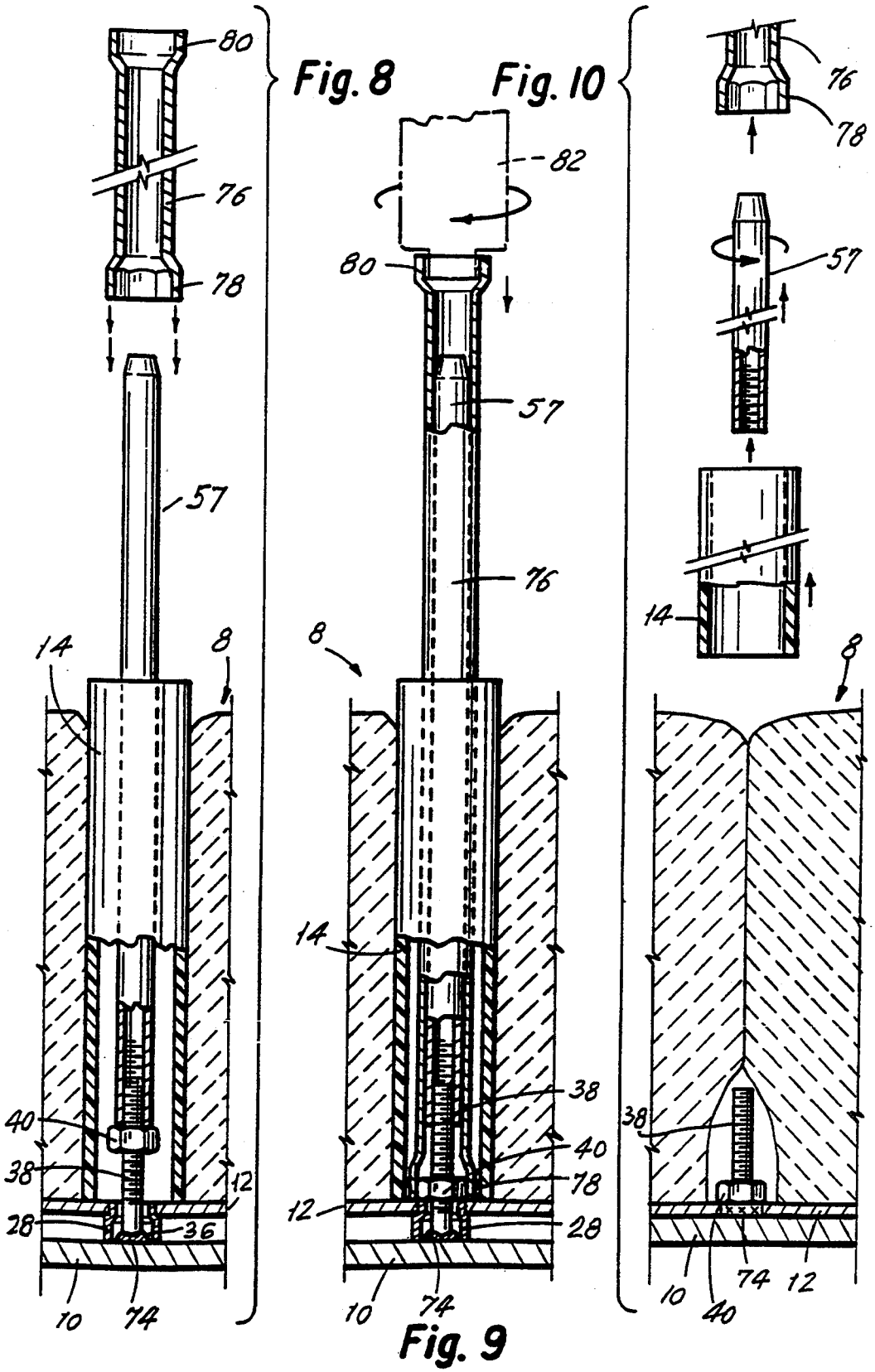
FIGS. 8, 9 and 10 are cross-sectional views of a module insulation assembly of the present invention being secured to a metal wall after it has been stud welded.

Once the stop collar 64A is adjusted to obtain the required clearance, the stud gun 50 is held steadily and pressed down, compressing the spring of the gun chuck 54, until the stud gun 50 abuts the stop collar 64A, as shown in FIG. 6. To initiate the weld cycle, the switch 58 is depressed causing the solenoid means of the gun chuck 54 to retract the threaded stud 38 from the wall 10 for a predetermined period of time. During this period current is supplied from the stud gun 50 through the current carrying rod 57 to the threaded stud 38 creating an arc between the tip 36 of the threaded stud 38 and the wall 10. This causes a pool of molten metal 74 to form on the surface of the wall 10 proximate to the tip 36 of the threaded stud 38. After the predetermined period of time the solenoid means of the gun chuck 54 automatically releases the gun chuck 54. The spring means of the gun chuck 54 then forces the gun chuck 54 and the current carrying rod 57 away from the stud gun 50 to cause the tip 36 of the threaded stud 38 to plunge into the molten metal 74 for the preset plunge dimension, as shown in FIGS. 8 and 9. The stud gun 50 should then be held steady for a few seconds to allow the molten metal 74 to solidify.

During the weld cycle, the larger diameter portion 32 of the ferrule 28 functions as a spacer to insulate the bracket 12 from the threaded stud 38 as shown in FIGS. 6, 8. The larger diameter portion 32 also serves to localize the molten metal 74 on the wall 10. The serrated edge 34 of the ferrule allows for the escape of gas.

Referring now to FIGS. 7–10, after the molten metal 74 has had ample time to solidify, thereby, forming a weld, the arc stud welding equipment save for the current carrying rod 57 is removed from the ceramic fiber module assembly 8. The nut 40 is then tightened to the required torque to firmly secure bracket 12 and, hence, the ceramic fiber module assembly 8 to the wall 10.

The nut 40 is tightened by placing an elongated tubular socket wrench 76 over the current carrying rod 57 until it engages the nut 40. The socket wrench 76 includes a nut-fitting end 78 formed in a hexagonal shape to rotationally engage nut 40. The opposite end of socket wrench 76 includes an adapter 80 typically formed in a square shape to fit a standard ratchet or power nut driver 82.

As shown in FIG. 10, as the nut 40 is tightened, the ferrule 28 is crushed between the anchor 12 and the wall 10. To verify the integrity of the weld 74, the nut 40 is tightened through the use of a manual wrench by a skilled operator or through the use of a torque wrench.

With the anchor 12 securely held against the wall 10, the ceramic fiber module assembly 8 is firmly secured in place. As shown in FIG. 10, the tubular socket wrench 76 is withdrawn, and then the current carrying rod 57 is withdrawn. By using the split collet stud adapter 72 instead of the threaded stud adapter 66, the threaded stud 38 is separated from the current carrying rod 57 by a pulling action, thereby, eliminating the need to unthread the current carrying rod 57 from the threaded stud 38 and speeding up the process of installing the ceramic fiber module assembly 8 to the wall 10.

The insulating tube 14 is withdrawn from the ceramic fiber module assembly 8 which permits the layers of ceramic fiber forming the ceramic fiber module assembly 8 to expand to close the space formally occupied by the insulating tube 14. The insulating tube 14 can be discarded or may be used in the manufacture of a new ceramic fiber module assembly 8, whichever is preferred.

The aforementioned procedure for installing the ceramic fiber module assembly 8 is repeated until the entire surface of wall 10 is covered by ceramic fiber module assemblies securely held to the wall 10. After the entire surface of wall 10 is covered, the straps 48 and then the cardboard panels 46 are removed from each of the modules.

It will be appreciated by those skilled in the art that to tighten the nut 40, the tubular socket wrench 76 may be extended over the current carrying rod 57 after the current carrying rod 57 has been disengaged from the stud gun 50, as shown and described above, or that the current carrying rod 57 may first be withdrawn from the insulating tube 14 and then placing the tubular socket wrench 76 in the insulating tube 14 to engage the nut 40. In either manner, rotation of the standard ratchet or power nut driver 82 rotates the tubular socket wrench 76 and the nut 40 which serves to secure the ceramic fiber module assembly 8 to the wall 10.

An alternate procedure may be employed to stud weld the ceramic fiber module assembly 8 to the wall 10. After the foot piece 59 and the guide legs 60 are assembled as per the stud gun manufacturer's instructions, the stop collar 64A is loosely installed on each guide leg 60. The guide legs 60 are then inserted through the channels 65 of the stud gun 50. The stop collar 64B is installed near the end of one of the guide legs 60 to prevent the stud gun 50 from sliding off of the guide legs 60.

The tube adapter 61 is next aligned with the opening 59A of the foot piece 59 and firmly secured in place by the set screws. The current carrying rod 57 is then installed through the tube adapter 61 and into the gun chuck 54. The current carrying rod 57 is to be centered in the tube adapter 61. The foot piece 59 is to be adjusted to obtain such alignment.

The stud and nut assembly 42 is inserted into the stud adapter 66 or 72 of the current carrying rod 57 until the nut 40 is seated against the stud adapter. The stud gun 50 is then slid on the guide legs 60 and the distance between the tip 36 of the threaded stud 38 and the shoulder portion 62 of the tube adapter 61 is adjusted to be X", wherein X equals the thickness of the ceramic fiber module 8. When this dimension is set, the stop collars 64A on the guide legs 60 are positioned against the stud gun 50 and secured by firmly tightening the set screws. The dimension should be checked frequently to assure that it has not changed.

The ferrule 28 is then installed into the opening 20 of the anchor 12 on the backside of the ceramic fiber module assembly 8 adjacent to the wall 10, as described above. The ceramic fiber module assembly 8 is then placed in the desired position against the wall 10 and held in place. The fitting 63 of the tube adapter 61 is inserted into the insulating tube 14 until the shoulder portion 62 of the tube adapter 61 abuts the end of the insulating tube 14. The stud gun 50 is held steadily and pressed down. The weld cycle is then initiated to secure the ceramic fiber module assembly 8 to the wall 10 as described above.

The insulation module assembly and method and apparatus for installation of the present invention can be stud welded directly through the module to a wall that requires insulation using standard available electric arc stud welding equipment and components. The assembly allows for the integrity of the weld to be easily verified. The assembly is simple and economical to manufacture, is easy to install and can be installed quickly and efficiently.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An apparatus in combination with an insulation module and a stud, the apparatus for attaching the insulation module to a wall with the stud, the combination comprising:

A) the stud;

B) the insulation module, the module being formed of insulation material having a cold face for presentation to the wall and a substantially hot face opposite to the cold face, the module including, 1) an anchor to anchor the insulation module to the wall, the anchor adapted to receive the stud, and 2) an electrically non-conductive tube member to guide the stud into functional relationship with the anchor and the wall through the hot and cold faces of the insulation module, the tube member including a first open end and an opposing second open end, and substantially extending from the cold face to the hot face of the insulation module; and C) the apparatus, the apparatus including, 1) a ferrule for electrically insulating the stud from the anchor;

2) a stud-welder for welding the stud to the wall, the stud-welder including a chuck capable of movement between a non-retracted position and a retracted position;

3) a tube adapter received by the tube member to support the stud-welder and to align the stud-welder in the proper axial position relative to the wall and the insulation module; and 4) an electrically conductive stud adapter to operatively engage the chuck of the stud-welder and the stud through the tube member, the stud adapter being so constructed and arranged for movement so that when the chuck is in the non-retracted position the stud is in contact with the wall and when the chuck is in the retracted position the stud is displaced away from the wall a predetermined amount sufficient to allow an electric arc to be initiated between the stud and the wall.

2. The combination of claim 1, further including means for fastening together the anchor and the stud to secure the insulation module to the wall.

3. The combination of claim 1, wherein the tube adapter facilitates seating the ferrule and the stud against the wall.

4. The combination of claim 3, wherein the tube adapter transmits manual force applied to the stud-welder to the anchor and the ferrule through the tube member.

5. The combination of claim 1, wherein the anchor includes a base portion and an arm portion that extends at an angle from an end of the base portion and away from the wall, the base portion and the arm portion each having an aperture formed therein.

6. The combination of claim 5, further including an elongated member received in the aperture of the arm portion for extending through at least some portion of the insulation module.

7. The combination of Claim 5, wherein the base portion of the anchor is oriented in a plane generally parallel to the wall proximate to the cold face of the insulation module.

8. The combination of claim 5, wherein the first open end of the tube member is aligned with the aperture of the base portion.

9. The combination of claim 8, wherein the second open end of the tube member extends through the hot face of the insulation module.

10. The combination of claim 5, wherein the ferrule includes a fitted portion adapted to be received in the aperture of the base portion between the base portion and the wall.

11. The combination of claim 10, wherein the aperture of the base portion of the anchor and the ferrule are sized to allow a portion of the stud to pass therethrough.

12. The combination of claim 1, wherein the stud is threaded and includes a threaded nut received by the threaded stud.

13. The combination of claim 1, wherein the tube adapter further includes a foot piece secured to and supported by the tube adapter, the foot piece and the tube adapter including means to allow the stud adapter to pass therethrough.

14. The combination of claim 13, wherein the foot piece includes means for slidingly engaging the stud adapter along an axis normal to the plane of the wall.

15. The combination of claim 14, wherein the stud adapter operatively engages the stud-welder with the stud through the tube member, the tube adapter and the foot piece.

16. The combination of claim 1, wherein the distance between a tip of the stud in contact with the wall and a shoulder portion of the tube adapter is substantially equal to the thickness of the insulation module.

17. The combination of claim 1, wherein the stud adapter includes means for retaining the stud at one end thereof.

18. The combination of claim 1, wherein the tube adapter includes a shoulder portion and a fitted portion, the fitted portion received by the second open end of the tube member such that the shoulder portion abuts the second open end.

19. An insulation system for insulating a wall, the system comprising:

A) a stud;

B) an insulation module formed of an insulation material, the insulation module including, 1) a cold surface;

2) a hot surface located opposite to the cold surface;

3) an anchor to anchor the insulation module to the wall, the anchor adapted to receive the stud; and 4) an electrically non-conductive tube member extending from the cold surface to the hot surface for guiding the stud into the anchor through the cold surface and the hot surface, the tube member having a first open end and a second open end; and C) an apparatus for fixing the insulation module to a wall with the stud, the cold surface of the insulation module contacting the wall when the insulation module is fixed to the wall, the apparatus including, 1) a ferrule for electrically insulating the stud;

2) a stud-welder for welding the stud to the wall, the stud-welder having a chuck movable between a non-retracted position and a retracted position;

3) a tube adapter received by the tube member for supporting the stud welder and aligning the stud welder with the wall and the insulation module; and 4) an electrically conductive stud adapter operatively engaging the chuck and the stud through the tube member, the stud adapter being constructed and arranged to cause the stud to contact the wall when the chuck is in the non-retracted position and to cause the stud to be spaced from the wall by an amount sufficient to allow an electric arc to be initiated between the stud and the wall when the chuck is in the retracted position.

20. The system of claim 19, further including means for fastening together the anchor and the stud to secure the insulation module to the wall.

21. The system of claim 19, wherein the tube adapter facilitates seating the ferrule and the stud against the wall.

22. The system of claim 21, wherein the tube adapter transmits manual force applied to the stud-welder to the anchor and the ferrule through the tube member.

23. The system of claim 19, wherein the anchor includes a base portion and an arm portion that extends at an angle from an end of the base portion and away from the wall, the base portion and the arm portion each having an aperture formed therein.

24. The system of claim 23, further including an elongated member received in the aperture of the arm portion for extending through at least some portion of the insulation module.

25. The system of claim 23, wherein the base portion of the anchor is oriented in a plane generally parallel to the wall proximate to the cold surface of the insulation module.

26. The system of claim 23, wherein the first open end of the tube member is aligned with the aperture of the base portion.

27. The system of claim 26, wherein the second open end of the tube member extends through the hot surface of the insulation module.

28. The system of claim 23, wherein the ferrule includes a fitted portion adapted to be received in the aperture of the base portion between the base portion and the wall.

29. The system of claim 28, wherein the aperture of the base portion of the anchor and the ferrule are sized to allow a portion of the stud to pass therethrough.

30. The system of claim 19, wherein the stud is threaded and includes a threaded nut received by the threaded stud.

31. The system of claim 19, wherein the tube adapter further includes a foot piece secured to and supported by the tube adapter, the foot piece and the tube adapter including means to allow the stud adapter to pass therethrough.

32. The system of claim 31, wherein the foot piece includes means for slidingly engaging the stud adapter along an axis normal to the plane of the wall.

33. The system of claim 32, wherein the stud adapter operatively engages the stud-welder with the stud through the tube member, the tube adapter and the foot piece.

34. The system of claim 19, wherein the distance between a tip of the stud in contact with the wall and a shoulder portion of the tube adapter is substantially equal to the thickness of the insulation module.

35. The system of claim 19, wherein the stud adapter includes means for retaining the stud at one end thereof.

36. The system of claim 19, wherein the tube adapter includes a shoulder portion and a fitted portion, the fitted portion received by the second open end of the tube member such that the shoulder portion abuts the second open end.

* * * * *